United States Patent [19]

King

[11] Patent Number: 4,760,682

[45] Date of Patent: Aug. 2, 1988

[54] TUBULAR RACK BEAM AND METHOD OF MAKING SAME

[75] Inventor: John R. King, West Bloomfield, Mich.

[73] Assignee: S & K Enterprises Inc., Detroit, Mich.

[21] Appl. No.: 46,081

[22] Filed: May 5, 1987

[51] Int. Cl.[4] ..... E04C 3/30

[52] U.S. Cl. ..... 52/731; 52/732

[58] Field of Search ..... 52/648, 730–732, 52/785

[56] References Cited

U.S. PATENT DOCUMENTS

| | | | |
|---|---|---|---|
| 3,234,704 | 2/1966 | Burgess et al. | 52/731 |
| 3,332,197 | 7/1967 | Hinkle | 52/731 |
| 3,411,252 | 11/1968 | Boyle, Jr. | 417/258 |
| 3,611,666 | 10/1971 | Poyser et al. | 52/731 |

FOREIGN PATENT DOCUMENTS

| | | | |
|---|---|---|---|
| 2829563 | 1/1980 | Fed. Rep. of Germany | 52/732 |

*Primary Examiner*—John E. Murtagh

*Assistant Examiner*—Andrew Joseph Rudy

*Attorney, Agent, or Firm*—Cullen, Sloman, Cantor, Grauer, Scott and Rutherford

[57] ABSTRACT

A hollow, tubular beam is formed of an outer and an inner, U-shaped, elongated, roll-formed, sheet metal channel which are telescopically interfitted. The overlapping adjacent leg portions of each channel are provided with an inwardly bent rib and groove mechanical connection, but the curvature of the adjacent rib and groove surfaces are slightly different to provide a number of longitudinally extending, separated spaces therebetween. The free edge of one of the legs of the outer channel is bent normally to cover a corresponding corner-like shoulder bent in the adjacent inner channel leg. The radii of the flange and shoulder bends are slightly different to provide a slight, longitudinally extending space between them. Also, overlapping leg portions are spaced apart by integral embossments formed on the legs. The adjacent channel legs are adhesively bonded together by an adhesive material applied within the spaces.

9 Claims, 1 Drawing Sheet

TUBULAR RACK BEAM AND METHOD OF MAKING SAME

BACKGROUND OF THE INVENTION

This invention relates to an improved beam of the type used in the construction of pallet racks and similar heavy-duty, load-bearing frames.

A typical pallet rack comprises a frame made of vertical posts which are interconnected by horizontal beams. Rigid slats or sheets may be positioned upon opposing beams to form shelves. Alternatively, the beams may be used alone like shelves. Horizontal platforms or pallets, loaded with articles to be stored, are positioned upon the opposed beams or the slats or sheets spanning the beams, where they are used. In essence, the rack is an open shelving arrangement.

In heavy-duty pallet racks or similar types of frames which are utilized to support heavy weights, the beams which extend horizontally between the corner posts and other parts of the frame, are made of sheet metal formed into tubes. These tubes are generally of a square or rectangular cross-section. One type of tubular beam, which is relevant to this invention, is made of a pair of roll-formed, open channels which are telescopically interfitted and secured together to provide the tubular shape. Here, one of the channels is formed with its legs more widely spaced apart then the other channel. The channel bases are arranged vertically and the legs horizontally. The channel with the closer legs is fitted between the wider legs of the one channel. Sometimes bent interfitting ribs and grooves are formed in the channel legs to mechanically hold them together. Then, the interfitted channels are welded together along their lengths to form a rigid tube.

The beam that is formed of the two interfitted channels is strong enough and rigid enough, assuming the use of proper dimensions and thicknesses of the metal, to support heavy weights. Thus, heavily loaded pallets may be rested upon a pair of parallel, spaced apart beams that are secured at their ends to upright posts.

These fabricated beams are relatively expensive to manufacture because of the need to weld the channels together. Typical welding, e.g., spot welding or MIG welding or the like, whether manually performed or performed in automatic machinery, takes considerable time and relatively expensive equipment. However, other means for rigidly and permanently interconnecting the two channels have not been satisfactory. Thus, the invention of this application is concerned with improving the two channel-type, tubular beam construction by reducing the time and equipment needed for fabricating the beam while at the same time producing a beam which is proportionately stronger than a corresponding prior-type welded beam.

SUMMARY OF INVENTION

The invention herein comtemplates permanently interconnecting the interfitted channels of a two-channel type beam with adhesive bonding so as to eliminate welding. For this purpose, a bent edge flange which is formed on one of the outer channel legs covers and engages a corresponding shoulder formed on the adjacent inner channel leg. Also, interfitted bent ribs and grooves, formed in the adjacent channel legs, mechanically hold the channels together as well as stiffening them. Adhesive is placed between the adjacent channel leg surfaces for strongly bonding the channel legs together.

To protect and increase the strength of the adhesive joints, the overlapping surfaces of the interfitted ribs and grooves formed on the channel legs, and the overlapping surface of the bent flange and the shoulder, are formed at slightly different curvatures relative to each other so as to provide a number of separate spaces of gaps between adjacent channel legs. In addition, bump-like embossments may be formed upon the channel legs to provide and to maintain gaps between the legs. Such gaps receive and substantially encapsulate portions of the adhesive material that bond the legs together. Thus, while the complete overlapped leg surface portions may be adhesively bonded together by a thin layer of adhesive material, the separate, narrow spaces which extend longitudinally of the beam channels form thicker, but protected, adhesive stripes.

Summarizing, an object of this invention is to provide a constructon enabling the use of an adhesive material, rather than spot welding, for rigidly interconnecting the two channels forming the beam. However, the adhesive joint constructions are mechanically strong and resist breakage under the shear, tension and compression forces encountered by the beams when they are used to support heavy loads.

Another object of this invention is to facilitate rapid fabrication of the beams, with little labor time and without additional tools or equipment, by forming the channels so that they can be pivotally pushed together after the wet adhesive is applied to the surfaces of the channel legs, and the channels will rigidly maintain their interfitted relationship while the adhesive sets.

These and other objects and advantages of this invention will become apparent upon reading the following description, of which the attached drawings form a part.

DETAILED DESCRIPTION

Figure 1:
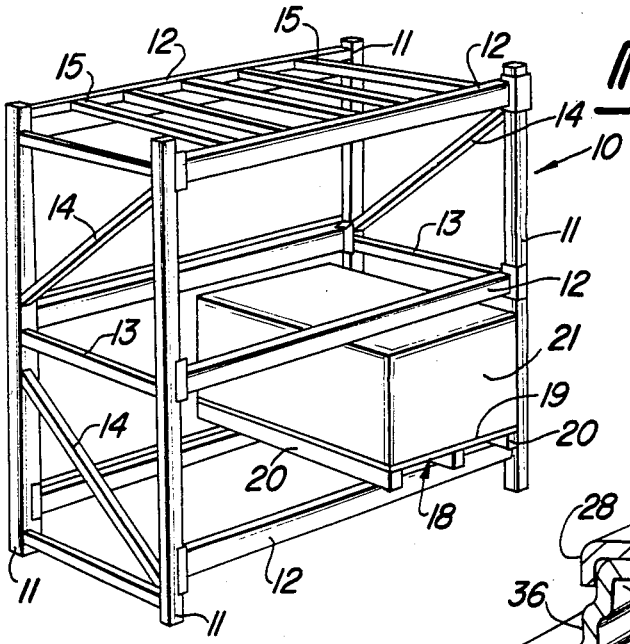
FIG. 1 is a perspective view of a typical pallet rack, with a single loaded pallet positioned in the rack.

FIG. 1 illustrates a typical pallet rack 10 which is formed of four vertical frame posts 11 that are interconnected by horizontal front and rear beams 12 and horizontal braces 13. In addition, the posts may be further connected together by angularly arranged cross braces 14 which stiffen the frame. Typically, the posts are made of metal tubes that are square or rectangular in cross-section. The tubes may be open-C sections or of a continuous cross-secton as illustrated. The horizontal braces 13 are similarly made, although usually of a smaller cross-sectional size than the frame posts. Similarly, the cross braces 14 may be made of tubular material or metal strips.

The invention of this application is concerned with the horizontal front and rear beams 12. These beams may be used as parallel, spaced apart, shelf-like supports, as illustrated in the lower and middle portions of FIG. 1. Alternatively, they may be bridged by metal or wood slats 15 (see upper portion of FIG. 1) or by a large, monolithic sheet, such as a plywood sheet or a corrugated sheet metal deck material or the like.

The pallet rack, in the illustration of FIG. 1, supports a pallet 18 made of a base sheet 19 formed of wood boards or of plywood, supported on skids 20 which, for example, may be made of wood 2×4's. Conventional wood or metal pallets are contemplated. A container 21 is secured upon the pallet. Various articles may be placed within the container or, alternatively, articles may be loaded directly upon the pallet.

The beams 12 are made to support considerable weight without bending or breaking. In the past, telescopically interfitted sheet metal channels have been used with the adjacent legs of the channels welded together to provide the stiffness and strength required.

The improved beam of this invention is formed of an outer channel 24 having a base 25 and upper and lower legs 26 and 27, respectively. The upper leg 26 is provided with an integrally, downwardly bent cover flange 28 on its free edge. In addition, both legs have inwardly bent, groove-like ribs 29.

Figure 2:
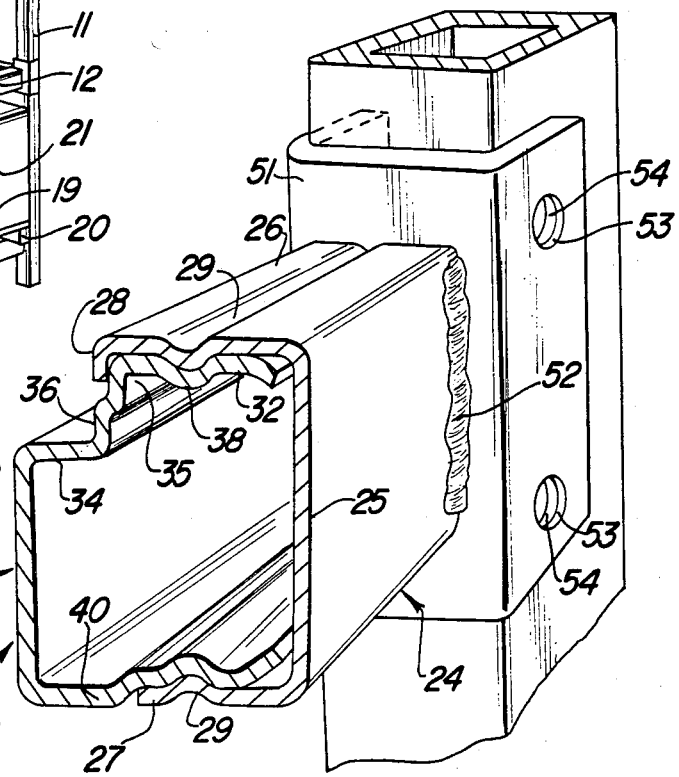
FIG. 2 is an enlarged, fragmentary view of the end portion of the pallet rack beam and its connection to the vertical post of the rack.

The inner channel 30 is provided with a base 31 which is narrower than the base 25 of the outer channel. The upper leg 32 of the inner channel is bent in step-like configuration. As shwon in FIGS. 2–4, the leg 32 is first bent to provide a horizontal, tread-like part 34 whose end is bent upwardly into a riser-like part 35 whose upper portion is bent to form an offset part 36 relative to the lower part of the riser part. The upper end of the riser-like part is bent to form a relatively sharp, but somewhat rounded, corner-like shoulder 37. An inwardly bent groove 38 is formed in the free inner portion of the leg 32 to receive the rib 29 of the leg 26 of the outer channel. The free end of the leg 32 is bent at a slight angle to form an angled edge portion or flange 39.

The inner channel lower leg 40 has its free edge portion 41 inwardly offset relative to the main leg portion 40. The offset part is provided with a groove 42 which receives the rib 29 of the lower leg 27 of the outer channel. The free edge of the offset leg portion 41 is provided with an acute angle edge or lead, flange 43 which may be sent on the order of roughly 40 degrees out of the plane of the leg portion.

A number of bump-like embossments 44 are formed in the upper leg 32 and lower leg portion 41 of the inner channel by punching or stamping dimples 44*a* on the inner faces of the legs. The embossments may be made in different shapes, as for example, round with a height of roughly 0.006 to 0.008 inches and spaced apart on 12 inch centers.

Figure 3:
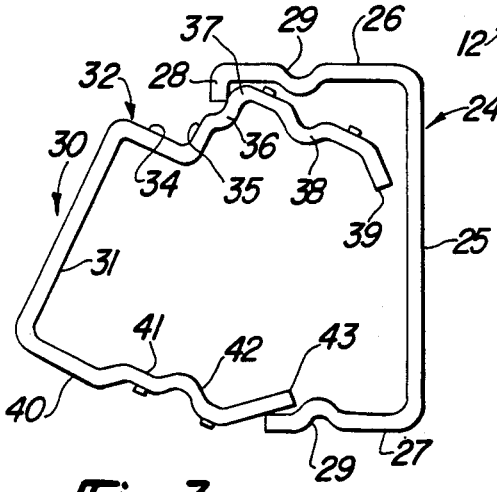
FIG. 3 is an end view showing the assembly of the two channels forming the beam.

The two channels are assembled, as illustrated in FIG. 3, by inserting the corner-like shoulder 37 of the inner channel 30, beneath the lip or edge flange 28. In that position, the angled edge flange or lead flange 43 partially enters the outer channel. At that point, the inner channel 30 is pushed and pivoted, as for example by pushing its lower portion, so that it pivots relative to the lip or flange 28. The lead flange 43 moves inwardly of the outer channel and resiliently springs the leg 27 of the outer channel sufficiently to permit entry of the corresponding portion of the lower leg 40 of the inner channel. The combination of pushing and pivoting results in interfitting the inner channel within the outer channel so that the two channels are mechanically interlocked due to the engagement between the ribs and grooves and the cover flange 28 and the shoulder 37.

Figure 4:
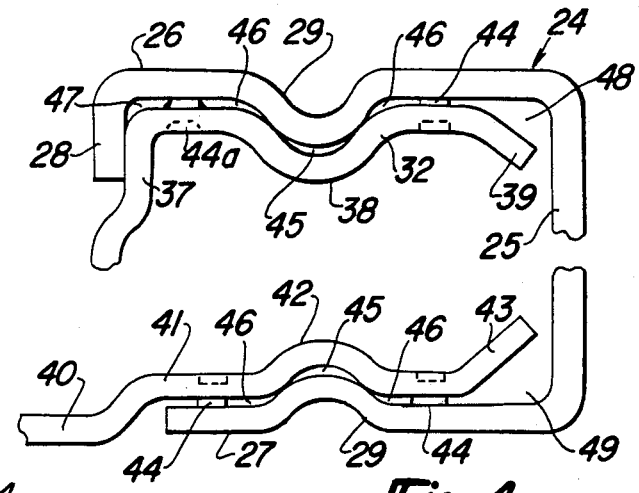
FIG. 4 is an enlarged, fragmentary end view of the assembled inner and outer channels.
Figure 5:
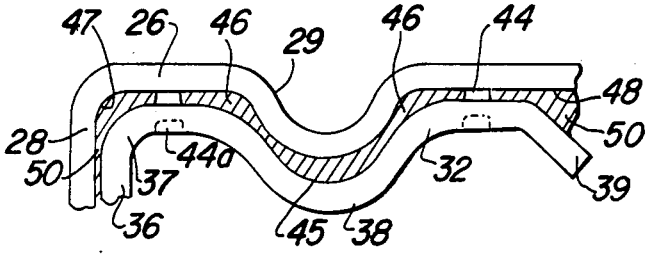
FIG. 5 is a fragmentary, more greatly enlarged view of a portion of the adjacent legs of the channels with adhesive applied therebetween.

As shown in FIG. 4, the curvature of the surfaces of the interfitted ribs and grooves and of the cover flange and shoulder are slightly different relative to each other. This may be accomplished by using slightly different radii of bending of the parts. The result is that separated gaps or spaces, that extend along the length of the beam, are formed between these parts. By way of example, center spaces 45 are formed between the engaged ribs 29 and their respective grooves 38 and 42. Likewise, narrow, longitudinally extending spaces 46 are formed along the opposite sides of the ribs and grooves between the adjacent channel legs by the embossments and by the different radii of bending. Also, a longitudinally extending, narrow space or gap 47 is formed between the shoulder 37 and the bent corner of the flange 28 due to the different radii of curvature.

Additional spaces or gaps 48 and 49 are provided between the bent flanges 39 and 43 formed on the free edges of the legs of the inner channel and the adjacent surface portions of the legs of the outer channel.

Before assembling the channels, as illustrated in FIG. 3, the overlapping surfaces of the legs of the inner and outer channels may be coated with a suitable adhesive material. Thus, when the legs of the inner channel are pivotally forced into position between the legs of the outer channel, the adhesive material may form a thin layer in the spaces between the closely adjacent surfaces of the legs and a considerably thicker layer in the wider spaces between the curves in the leg surfaces. The separate, longitudinally extending spaces or gaps provide protective enclosures to encapsulate the adhesive and to reinforce the joints formed by the adhesive.

By way of example, the thickness of the adhesive layer between the overlapped closely adjacent leg surfaces may run from 0, (i.e. direct surface to surface contact), to roughly 0.006 inches thick while the thickness of the spaces or gaps may be considerably more. The thickness of the gaps or spaces may vary, depending upon manufacturing tolerances and the nature of the materials used., as well as the desired strength of the joints produced. Significantly, the edge flange 28 not only serves to act as a pivot point for assembly of the channels, and as a wall of a container-like space for the adhesive, but it also acts as a strengthening rib or column to resist bending of the beam.

The overall tubular construction, particularly with the longitudinally extending, relatively thick, separated adhesive stripes formed by the filled gaps, resists the shear, tension and compressive forces that result from heavy loading of the beam, as well as from any bending of the beam due to heavy pallet loads.

The beams are secured to the vertical posts of the frame or rack in any conventional manner. By way of example, the oposite ends of the beam may be secured to U-shaped connectors 51 by means of welded beads 52. Openings 53 may be formed in the connector to overlie similar openings 54 in the vertical posts for the reception of suitable fasteners, such as bolts or rivets or pins or other conventional mechanical locking devices which are used for this purpose. The connection between the connectors and the posts are conventional and therefore not further described.

The foregoing describes an operative embodiment of this invention. This invention may be further developed within the scope of the following claims.

What is claimed is:

1. A tubular beam comprising:

a pair of opposed, elongated, generally U-shaped, bent sheet metal channels forming an outer channel having a base and spaced apart integral outer legs and an inner channel having a base and spaced apart inner legs;

the free edge of one of said outer legs terminating in an integral bent cover flange extending towards the opposite outer leg;

the inner legs have free edge portions arranged between the outer legs and overlapped by and snugly held against their adjacent outer leg surfaces so that the channels are tightly interfitted to form a hollow, tubular shape;

an integral bent corner-like shoulder formed in, and extending along the length of, the inner leg that is adjacent the outer leg havign said flange, and said flange fitting over and engaging said shoulder;

and an adhesive material arranged between, and adhesively bonding together the adjacent, overlapping inner and outer leg surfaces.

2. A tubular beam as described in claim 1, and including the adjacent, overlapped, inner and outer leg surfaces having a number of longitudinally extending, separated areas of narrow spaces formed between them, into which spaces adhesive material is positioned.

3. A tubular beam as defined in claim 1, and including the interior surface of the bent flange overlapping the surface of the bent corner-like shoulder, but having a slightly greater radius of bend than the radius of bending of the exterior surface of said shoulder, so as to provide a narrow longitudinally extending space for receiving adhesive material.

4. A tubular beam as defined in claim 1, and including an elongated, bent groove formed in each of the overlapped inner and outer legs which form one of the pairs of adjacent legs, with the grooves bent inwardly of their respective channels to form a rib in the outer leg that is aligned with and is fitted into the groove in the inner channel;

the cross-sectional curvatures of the overlapping rib and groove surfaces being slightly different relative to each other so as to form longitudinally extending, narrow, separated spaces between the ribs and grooves for the reception of adhesive material.

5. A tubular beam as defined in claim 4, and including a number of bump-like embossments formed on at least some of the legs to extend between the space apart the overlapping portions of the inner and outer legs for providing spaces therebetween for receiving adhesive material.

6. A tubular beam as defined in claim 5, and including the free edge portion of the inner leg, which is opposite to the inner leg having the shoulder, being formed as a narrow, lead flange that is bent at an acute angle relative to its leg, with the angle being predetermined to cause the adjacent outer leg to spring ouwardly sufficiently for entry of the lead flange and its leg into the outer channel after the shoulder and its leg are inserted within the channel with the shoulder fitted within the cover flange and while the shoudler and its inner channel are rotated relative the cover flange and outer channel for interfitting the two channels.

7. A tubular beam as defined in claim 5, and with the base of the inner channel being narrower than the base of the outer channel;

and with the inner leg that has a shoulder being formed with a step-like bend in cross-section, that is, with a step tread-like portion integrally bent from the inner channel base and extending generally parallel to the opposite inner leg and then integrally away from said opposite inner leg like a step riser-like portion and thereafter bent generally parallel to the opposite inner leg to form the corner-like shoulder.

8. A tubular beam as defined in claim 7, and including said riser-like portion being bent to form a lower portion that is approximately coplanar with the outer leg cover flange, and an upper portion which is inwardly offset relative to, and engaged with, the cover flange, so that the cover flange together with said lower portion forms a generally flat step riser-like shape.

9. A tubular beam as defined in claim 8, and including the free edge portion of the opposite inner leg being bent inwardly relative to the section of the leg which is directly integral with the base of the inner channel so that the adjacent overlapping outer leg portion is substantially coplanar with said section.

* * * * *